US009513006B2

(12) United States Patent
Krichtafovitch et al.

(10) Patent No.: US 9,513,006 B2
(45) Date of Patent: Dec. 6, 2016

(54) ELECTRODYNAMIC BURNER WITH A FLAME IONIZER

(71) Applicant: ClearSign Combustion Corporation, Seattle, WA (US)

(72) Inventors: Igor A. Krichtafovitch, Kirkland, WA (US); Christopher A. Wiklof, Everett, WA (US); Joseph Colannino, Bellevue, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 634 days.

(21) Appl. No.: 14/092,911

(22) Filed: Nov. 27, 2013

(65) Prior Publication Data

US 2015/0147706 A1 May 28, 2015

Related U.S. Application Data

(60) Provisional application No. 61/730,486, filed on Nov. 27, 2012.

(51) Int. Cl.

| | |
|---|---|
| ***F23N 5/00*** | (2006.01) |
| ***F23D 14/84*** | (2006.01) |
| ***F23N 5/12*** | (2006.01) |
| ***F23C 99/00*** | (2006.01) |

(52) U.S. Cl.

CPC ..... *F23N 5/00* (2013.01); *F23C 99/001* (2013.01); *F23D 14/84* (2013.01); *F23N 5/12* (2013.01)

(58) Field of Classification Search

CPC ..... F23N 5/00; F23N 5/12; F23D 14/84; F23C 99/001

USPC ..... 431/2, 18, 264, 253; 60/722, 779

See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |
| 3,087,472 | A | 4/1963 | Asakawa |
| 3,167,109 | A | 1/1965 | Wobig |
| 3,224,485 | A | 12/1965 | Blomgren et al. |
| 3,306,338 | A | 2/1967 | Wright et al. |

(Continued)

FOREIGN PATENT DOCUMENTS

| | | |
|---|---|---|
| FR | 2577304 | 12/1989 |
| GB | 932955 | 7/1963 |

(Continued)

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — Gregory Huson
*Assistant Examiner* — Nikhil Mashruwala
(74) *Attorney, Agent, or Firm* — Christopher A. Wiklof; Nicholas S. Bromer; Launchpad IP, Inc.

(57) ABSTRACT

An ionizer provides charged particles to charge a combustion reaction. A conductive flame holder cooperates with the charged combustion reaction to hold the combustion reaction away from a fuel nozzle. Dilution and/or premixing of the fuel in the region between the fuel nozzle and the conductive flame holder results in a reduced flame temperature. The reduced flame temperature results in a reduced output of oxides of nitrogen (NOx).

14 Claims, 11 Drawing Sheets

(56) References Cited

U.S. PATENT DOCUMENTS 3,358,731 A 12/1967 Donnelly
3,416,870 A 12/1968 Wright
3,503,348 A 3/1970 Dvirka
3,749,545 A 7/1973 Velkoff
3,841,824 A 10/1974 Bethel
3,869,362 A 3/1975 Machi et al.
4,052,139 A 10/1977 Paillaud et al.
4,091,779 A 5/1978 Saufferer et al.
4,093,430 A 6/1978 Schwab et al.
4,110,086 A 8/1978 Schwab et al.
4,111,636 A * 9/1978 Goldberg ..... F23C 99/001 431/2
4,118,202 A 10/1978 Scholes
4,219,001 A 8/1980 Kumagai et al.
4,260,394 A 4/1981 Rich
4,304,096 A 12/1981 Liu et al.
4,340,024 A 7/1982 Suzuki et al.
4,439,980 A 4/1984 Biblarz et al.
4,649,260 A 3/1987 Melis et al.
4,675,029 A 6/1987 Norman et al.
4,903,616 A 2/1990 Mavroudis
4,987,839 A 1/1991 Krigmont et al.
5,702,244 A 12/1997 Goodson et al.
6,247,921 B1 6/2001 Helt
6,640,549 B1 11/2003 Wilson et al.
6,736,133 B2 5/2004 Bachinski et al.
6,742,340 B2 6/2004 Nearhoof, Sr. et al.
6,918,755 B1 7/2005 Johnson et al.
7,137,808 B2 11/2006 Branston et al.
7,159,646 B2 1/2007 Dessiatoun et al.
7,168,427 B2 1/2007 Bachinski et al.
7,182,805 B2 2/2007 Reaves
7,226,496 B2 6/2007 Ehlers
7,226,497 B2 6/2007 Ashworth
7,243,496 B2 * 7/2007 Pavlik ..... F23C 99/001 431/2
7,377,114 B1 5/2008 Pearce
7,523,603 B2 4/2009 Hagen et al.
7,845,937 B2 12/2010 Hammer et al.
8,082,725 B2 12/2011 Younsi et al.
8,245,951 B2 8/2012 Fink et al.
8,911,699 B2 12/2014 Colannino et al.
9,284,886 B2 3/2016 Breidenthal et al.
9,310,077 B2 4/2016 Breidenthal et al.
2005/0208442 A1 9/2005 Heiligers et al.
2007/0020567 A1 1/2007 Branston et al.
2010/0183424 A1 7/2010 Roy
2011/0027734 A1 2/2011 Hartwick et al.
2011/0203771 A1 * 8/2011 Goodson ..... F15D 1/02 165/96
2012/0317985 A1 12/2012 Hartwick et al.
2013/0004902 A1 1/2013 Goodson et al.
2013/0071794 A1 3/2013 Colannino et al.
2013/0170090 A1 7/2013 Colannino et al.
2013/0230810 A1 9/2013 Goodson et al.
2013/0230811 A1 9/2013 Goodson et al.
2013/0255482 A1 10/2013 Goodson
2013/0255548 A1 10/2013 Goodson et al.
2013/0255549 A1 10/2013 Sonnichsen et al.
2013/0260321 A1 10/2013 Colannino et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0038113 A1 2/2014 Breidenthal et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0170569 A1 6/2014 Anderson et al.
2014/0170571 A1 6/2014 Casasanta, III et al.
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0234786 A1 8/2014 Ruiz et al.
2014/0234789 A1 8/2014 Ruiz et al.
2014/0248566 A1 9/2014 Krichtafovitch et al.
2014/0251191 A1 9/2014 Goodson et al.
2014/0255855 A1 * 9/2014 Krichtafovitch ..... F23N 5/00 431/2
2014/0255856 A1 9/2014 Colannino et al.
2014/0272731 A1 9/2014 Breidenthal et al.
2014/0287368 A1 * 9/2014 Krichtafovitch ..... F23N 5/00 431/8
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147705 A1 5/2015 Colannino et al.
2015/0219333 A1 8/2015 Colannino et al.
2015/0241057 A1 8/2015 Krichtafovitch et al.
2015/0276211 A1 10/2015 Colannino et al.
2015/0338089 A1 11/2015 Krichtafovitch et al.
2015/0345780 A1 12/2015 Krichtafovitch
2015/0345781 A1 12/2015 Krichtafovitch et al.
2015/0362178 A1 12/2015 Karkow et al.
2016/0018103 A1 1/2016 Karkow et al.
2016/0033125 A1 2/2016 Krichtafovitch et al.
2016/0040872 A1 2/2016 Colannino et al.
2016/0091200 A1 3/2016 Colannino et al.
2016/0123576 A1 5/2016 Colannino et al.
2016/0138800 A1 5/2016 Anderson et al.
2016/0161110 A1 6/2016 Krichtafovitch et al.

FOREIGN PATENT DOCUMENTS

JP 58-019609 2/1983
JP 60-216111 10/1985
WO WO 96/01394 1/1996
WO WO 2015/038245 3/2015
WO WO 2015/042566 3/2015
WO WO 2015/051136 4/2015
WO WO 2015/051377 4/2015
WO WO 2015/057740 4/2015
WO WO 2015/070188 5/2015

OTHER PUBLICATIONS

William T. Brande; "The Bakerian Lecture: on Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

* cited by examiner

ELECTRODYNAMIC BURNER WITH A FLAME IONIZER

CROSS-REFERENCE TO RELATED APPLICATIONS

The present application claims priority benefit from U.S. Provisional Patent Application No. 61/730,486 entitled "MULTISTAGE IONIZER FOR A COMBUSTION SYSTEM" filed Nov. 27, 2012; which, to the extent not inconsistent with the disclosure herein, is incorporated by reference.

The following U.S. Patent Applications, filed concurrently herewith, are directed to subject matter that is related to or has some technical overlap with the subject matter of the present disclosure, and are incorporated herein by reference, in their entireties: U.S. patent application Ser. No. 14/092,857; U.S. patent application Ser. No. 14/092,836; U.S. patent application Ser. No. 14/092,814; U.S. patent application Ser. No. 14/092,896; and U.S. patent application Ser. No. 14/092,876.

SUMMARY

According to an embodiment, an electrodynamic burner includes a fuel nozzle configured to provide fuel, an ionizer configured to output charged particles and positioned away from the fuel nozzle and the combustion reaction, and configured to apply corresponding charges to a combustion reaction supported by the fuel. An electrically conductive flame holder is positioned away from the fuel nozzle. The charge applied to the flame by the charged particles interacts with the flame holder to hold the combustion reaction proximate to the flame holder. A lift distance between the fuel nozzle and the conductive flame holder operates as a mixing zone to entrain air and/or flue gas into the fuel. The entrainment and dilution of the fuel in turn reduces combustion reaction temperature to reduce the production of oxides of nitrogen (NOx) by the burner.

DETAILED DESCRIPTION

Figure 1:
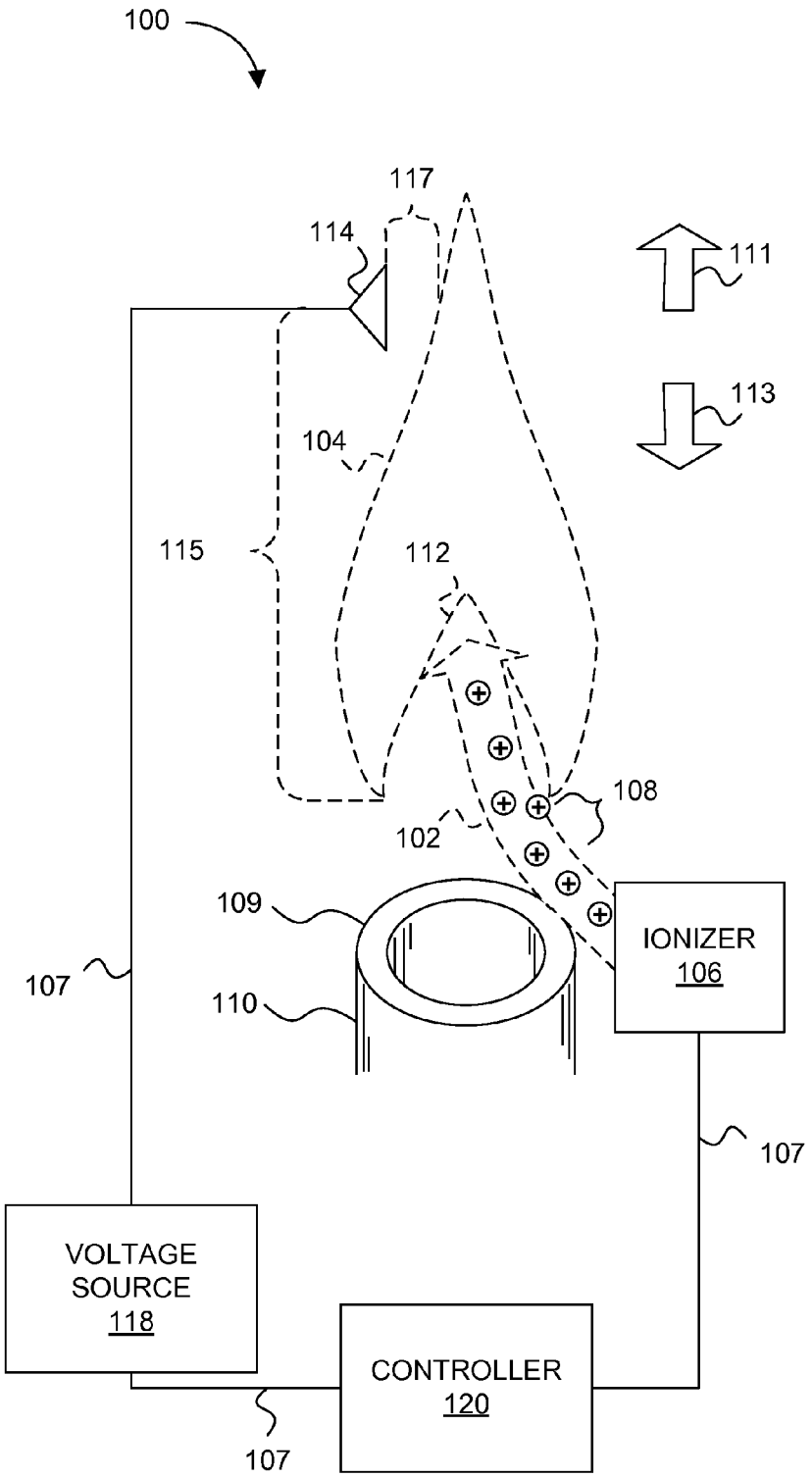
FIG. 1 is a block diagram of a combustion system with an ion flow upstream of a reaction front to control a combustion reaction, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

The inventors have recognized that electrodes in contact with, or in close proximity to the combustion reaction may be damaged by heat or reactive species from the combustion reaction, which can reduce the ability to control the combustion reaction. For example, electrodes with limited surface area, small radius of curvature, and/or sharp edges, such as may be employed for charge injection or corona electrodes, are frequently susceptible to such damage. Additionally, electrodes made from certain materials may be susceptible to such damage, in some cases so susceptible that such damage may discourage the use of otherwise desirable electrode materials for cost or practicality reasons. Moreover, electrode replacement is costly in terms of combustion reaction downtime, electrode materials, and/or labor, not to mention reduced control efficiency of such electrodes prior to replacement.

According to some embodiments, a combustion reaction charging system having "active", or current-carrying parts in a combustion volume, may require a more extensive procedure to replace broken or worn parts and/or may require shutdown or large fuel turn-down to access the broken or worn parts. Accordingly, service and reliability can be positively affected by placing active parts outside the combustion volume.

The inventors propose providing an ionizer mechanism configured to create charged particles, which are then introduced to the combustion reaction as a means of applying an electrical charge to the combustion reaction. The charged particles can be drawn from any appropriate material or combination of materials, including, for example, components of the combustion reaction, such as oxidizer gas (e.g., air), fuel, flue gas, reactants, etc. According to an embodiment, the ionizer mechanism may include an ion beam generator, such as an electron beam source. According to another embodiment, the ionizer mechanism may include a corona electrode and counter electrode pair immersed in a flow of dielectric fluid, such as a gas, which is to be introduced into the combustion volume. The corona electrode and counter electrode pair are configured to create ions from (deposit charges on) molecules of the dielectric fluid, or from other donor substances carried by the fluid.

The ionizer may be provided as a module or modular system configured for field exchange or replacement.

The term combustion reaction is to be construed as referring to an exothermic oxidation reaction. In some cases a combustion reaction can include a stoichiometric (e.g., visible) surface. In other cases, the combustion reaction may be "flameless" such that no visible boundary exists.

Combustion components refers to elements that are to be introduced into the combustion volume, and that will be involved in the combustion process, such as fuel, oxidizer, EGR flue gases, modifiers, catalysts, and other substances that may be introduced. This term is not limited to reference to these elements as they are present within the combustion volume, but also prior to their introduction into the combustion volume.

Combustion volume refers to the space within which a combustion reaction occurs, and is delineated according to the circumstances of the particular application. For example, many systems include a firebox or other enclosure configured to contain the combustion reaction and its products, and/or to protect individuals from the reaction. In such cases, corresponding boundaries and dimensions of the combustion volume are defined by walls or surfaces of the enclosure, to the extent reasonable. Any barrier configured to protect an element positioned on one side of the barrier from thermal energy produced by a combustion reaction positioned on an opposite side of the barrier can define a respective boundary of the combustion volume. Thus, for example, a smaller enclosure positioned partially or wholly within a combustion volume and configured to protect a circuit or other device from heat produced by a combustion reaction effectively removes the volume defined by the smaller enclosure from the combustion volume.

Where an enclosure is not present, or where portions of an enclosure are far enough from the combustion reaction that they do not effectively constrain aspects of the combustion reaction, the combustion volume can be defined as the volume within which the ambient temperature is at least 400° F. The combustion volume also includes regions that are significantly hotter than 400° F. For example, a temperature of up to near the adiabatic flame temperature can be encountered in some practical combustion systems.

Generally, the opening, i.e., terminus, of a fuel nozzle or burner that is configured to support the combustion reaction defines a boundary or limit of the combustion volume, such that fuel flowing from the nozzle enters the combustion volume as it is emitted from the nozzle. Likewise, nozzles, openings, vents, etc. by which other components of a combustion reaction are introduced can define respective boundaries of a combustion volume. Another boundary is at the approximate point within an exhaust passage, such as a flue or chimney, at which the exothermic process is no longer self-sustaining.

Embodiments illustrating the use of charged particles for applying a charge to a combustion reaction are primarily described in the present disclosure with reference to ions and ionizers. However, this is merely illustrative. Other varieties of charged particles are well known, as are mechanisms for their production. The term charged particle, as used in the claims, is not limited to ions, but is to be construed broadly as reading on any type of charged particle, i.e., any particle that is not electrically neutral. In some cases, the charged particles may be present in the form of free- or loosely associated-electrons. In other cases, the charged particles can include at least a nucleus, as in a H+, and/or can include a charged atomic pair or charged molecule. It will be understood that descriptions related to the production of ions herein may also apply to the production of charged particles that are not ions per se (e.g., electrons).

FIG. 1 is a block diagram of system 100 for employing an ion flow 102 to control a combustion reaction 104, according to an embodiment.

According to an embodiment, the system 100 includes an ionizer 106, which is configured to provide an ion flow 102 to a first location 108 with respect to the opening of a nozzle or terminus 109 of a burner 110 supporting a combustion reaction 104. The ion flow 102 has a first polarity. The ion flow 102 is configured to impart a net charge to the combustion reaction 104, or a component thereof. A first electrode 114 can be positioned at a second location 115 that is downstream 111 of the first location 108 and at least intermittently separated from the combustion reaction 104 by an air gap 117. A voltage source 118 is operatively coupled to the first electrode 114. A controller 120 is operatively coupled to provide one or more electrical signals to the ionizer 106 and the voltage source 118. The controller can be configured to control the combustion reaction 104 by selection of the one or more electrical signals. The first location 108 is at least intermittently upstream 113 with respect to a reaction front 112 of the combustion reaction 104. According to embodiments, the controller 120 is configured to control the voltage supply and the ionizer 106 to maintain the air gap 117 between the combustion reaction 104 and the first electrode 114. In other embodiments, the first electrode 114 can be electrically insulated, such as by a fused quartz glass. In other embodiments. The first electrode 114 can be in electrical continuity with the combustion reaction. Current flow through the combustion reaction can be controlled by maintaining resistance between the first electrode 114 and a voltage source for the first electrode, for example.

The terms upstream, indicated in the drawings by the arrow 111, and downstream, indicated by arrow 113, are with reference to a composite flow associated with a combustion reaction that includes, for example, a fuel flow, an oxidizer flow, a flow of reactants within the combustion reaction, and a flow of products of the combustion reaction, i.e., flue gas and its various components. Use of these terms without further modification or definition can be construed as referring to relative positions along this composite flow.

According to various embodiments, the ion flow 102 is selected to impart the charge and the first polarity to the combustion reaction 104. Additionally or alternatively, the ion flow 102 may be selected to impart the charge and the first polarity to a fuel of the combustion reaction 104. Additionally or alternatively, the ion flow 102 may be selected to impart the charge and the first polarity to an oxidizer of the combustion reaction 104. Additionally or alternatively, the ion flow 102 may be selected to impart the charge and the first polarity to a carrier gas of the combustion reaction 104. Additionally or alternatively, the ion flow 102 may be selected to impart the charge and the first polarity to a product of the combustion reaction 104. Additionally or alternatively, the ion flow 102 may be selected to impart the charge and the first polarity to any combination thereof of the fuel, oxidizer, carrier gas, and/or product of the combustion reaction.

According to various embodiments, the controller 120 is configured to control the combustion reaction 104 by providing the one or more electrical signals carried by signal carriers 107, such as wires. The one or more electrical signals carried by the signal carriers 107 may cause an increase or decrease in one or more of a height of the combustion reaction 104 or a surface area of the combustion reaction 104. Additionally or alternatively, the one or more electrical signals carried by the signal carriers 107 may cause the combustion reaction 104 to be directed to a selected location or to be directed away from the selected location. For example, this can be use to affect heat transfer and/or affect another combustion reaction ignition location. Additionally or alternatively, the one or more electrical signals carried by the signal carriers 107 may cause an oscillation in the combustion reaction 104. Additionally or alternatively, the one or more electrical signals carried by the signal carriers 107 may dynamically control a shape of the combustion reaction 104 or a movement of the combustion reaction 104. Additionally or alternatively, the one or more electrical signals carried by the signal carriers 107 can affect the luminance of the combustion reaction 104. Additionally or alternatively, the one or more electrical signals carried by the signal carriers 107 can be used to control a flame holding position; wherein a first flame holding position is proximal and a second flame holding position is distal.

The controller 120 is configured to cause the ionizer to instantaneously extract ions of a single polarity or add ions of a single polarity at the one or more first electrodes 114 from/to the combustion reaction 104, according to an embodiment.

The first electrode 114 can be configured to affect various characteristics of the combustion reaction 104 such as, for example, shape, location, luminosity, reaction rate. Depending on resistance through the first electrode to an electrical potential different from the electrical potential imparted onto the combustion reaction 104 by the ionizer 106, the first electrode can additionally or alternatively affect charge concentration in the combustion reaction 104. The controller 120, together with the voltage source 118, can be configured to hold the combustion reaction 104 at a surface of the burner 110. In the example of FIG. 1, the "burner" 110 may be embodied as a fuel nozzle 109 and flame holder 114 (aka, the first electrode), and the flame holder can operate as a flame holding surface. Not shown, a distal flame holder can hold the combustion reaction 104 when the controller 120 does not cause the voltage source 118 to hold the combustion reaction at the flame holder/first electrode 114.

According to an embodiment, the burner 110 is electrically isolated and/or insulated from electrical ground and from voltages other than those defined by the ionizer 106 and/or the first electrode 114. According to various embodiments, the controller 120 is configured to apply the one or more electrical signals to the one or more first electrodes 114. The controller 120 can cause a charge carried by the combustion reaction 104 to respond to the one or more electrical signals applied to the ionizer 106 and/or the first electrode 114.

The controller 120 can be configured to operate the ionizer 106 to periodically or intermittently change a quantity or a concentration of charge in the ion flow 102 or in the combustion reaction 104. Additionally or alternatively, the controller 120 can be configured to operate the ionizer 106 to periodically or intermittently change the first charge polarity in the ion flow 102 or in the combustion reaction 104. The one or more electrical signals can be characterized by one or more voltages. Additionally or alternatively, the one or more electrical signals can be controlled to influence or control an electrical field adjacent to the combustion reaction 104. The one or more electrical signals can include a time-varying signal configured to control the ionizer 106 to output a time-varying charge and/or control the first electrode 114 to deplete a charge carried by the combustion reaction 104 in a time-varying way. Additionally or alternatively, the one or more electrical signals can include a time-varying voltage. Additionally or alternatively, the one or more electrical signals can be switched to provide a time-varying electrical continuity to the ionizer 106 and/or the first electrode 114.

The combustion reaction 104 can be embodied as a visible flame or can consist essentially of a flameless reaction, according to embodiments.

As previously noted, according to the embodiment of FIG. 1, the ionizer 106 is configured to provide an ion flow 102. As used herein, ion flow refers to a flow of ions (including precursor ions (e.g., ions that will subsequently be converted to charges carried by other particles), to the extent that they may be present) in some medium (theoretically, the medium could be comprised substantially 100% of ions, however typical ionizer technologies do not provide such a high charge carrying efficiency) through space to a combustion reaction 104, with the ions carried by the ion flow then being substantially transferred to the combustion reaction 104. An ion flow may be provided by ionizing a gas, and the gas may then flow through space to the combustion reaction 104. The ionized gas can include a fuel, such as a hydrocarbon gas; or can include an oxidant flow, such as air. Additionally or alternatively, an ion flow may be provided by ionizing a gas in the form of a dielectric vapor. An ion flow may be provided by ionizing particles or droplets in an aerosol. An ion flow may be provided by ionizing molecules of a dielectric liquid. An ion flow may be provided by depositing ions on a particulate solid. Combinations of the above-described ion flows may become evident with further variations that fall within the scope of claims appended hereto.

In an embodiment, the ionizer 106 is configured to provide the ion flow 102 by contacting the ion flow 102 to at least one of air or a fuel. The ion flow 102 can be contacted to air or may consist essentially of combustion air to form a charged air flow. Additionally or alternatively, the ion flow 102 can be contacted to or consist essentially of fuel to form a charged fuel flow. Additionally or alternatively, the ion flow 102 is contacted to at least one of air or a fuel or can consist essentially of a fuel/air mixture to form a charged fuel/air mixture flow. In the case of charging a fuel/air mixture, care should be taken to prevent any inadvertent spark discharge that could cause detonation.

According to embodiments, the ionizer 106 can be configured to provide the ion flow 102 at a positive polarity. Additionally or alternatively, the ionizer 106 may configured to provide the ion flow 102 at a negative polarity.

According to an embodiment, the controller 120 is configured to control the combustion reaction 104 such that the first location 108 is substantially upstream 113 (e.g., averaged over time) with respect to the reaction front 112 of the combustion reaction 104. For example, the first location can include a flow distance through which the ion flow 102 travels between the ionizer 106 and the combustion reaction 104.

Figure 5A:
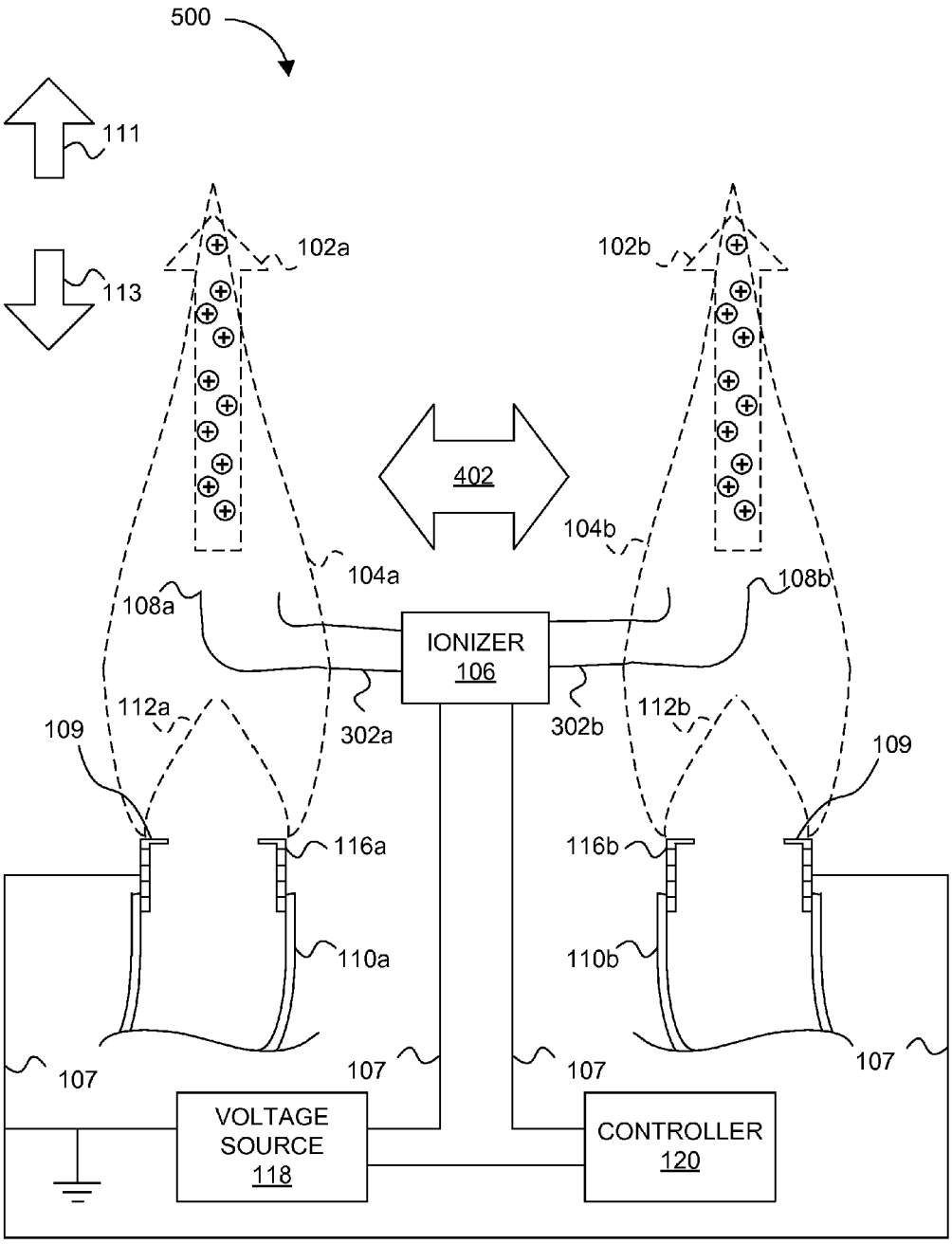
FIG. 5A is a block diagram of a combustion system, according to an embodiment.
Figure 5B:
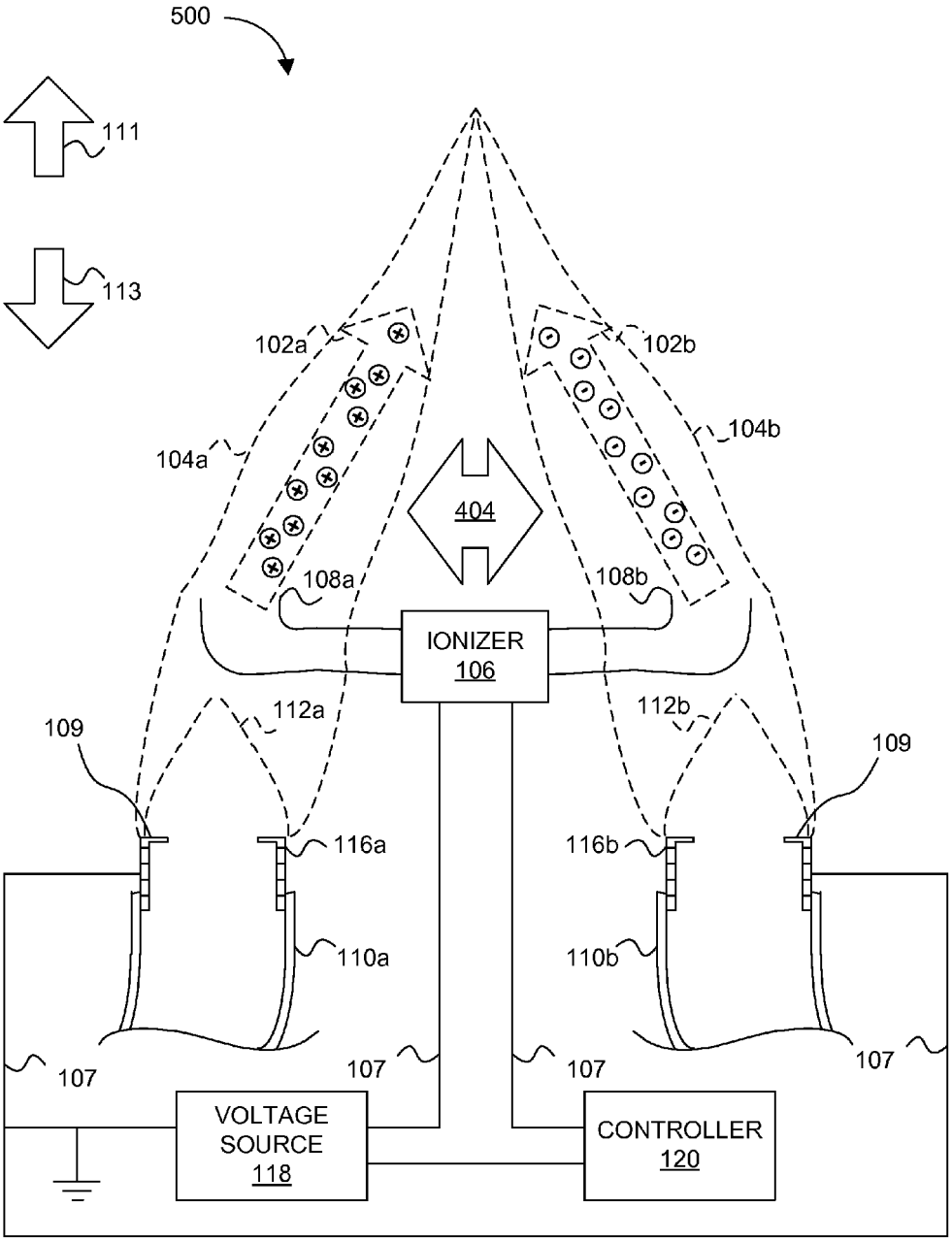
FIG. 5B is a block diagram of the system of FIG. 5A in which the ion flows have opposite polarities, according to an embodiment.

According to another embodiment, the ionizer 106 can output the ion flow 102 to the combustion reaction 104 above the lower reaction front 112. For example, as shown in FIGS. 5A, 5B, the ionizer can output an ion flow to the combustion reaction 104 through a conduit 302 including at least a dielectric portion configured to guide the ion flow while maintaining electrical isolation of the combustion reaction 104 with respect to the ionizer body 106.

Figure 2A:
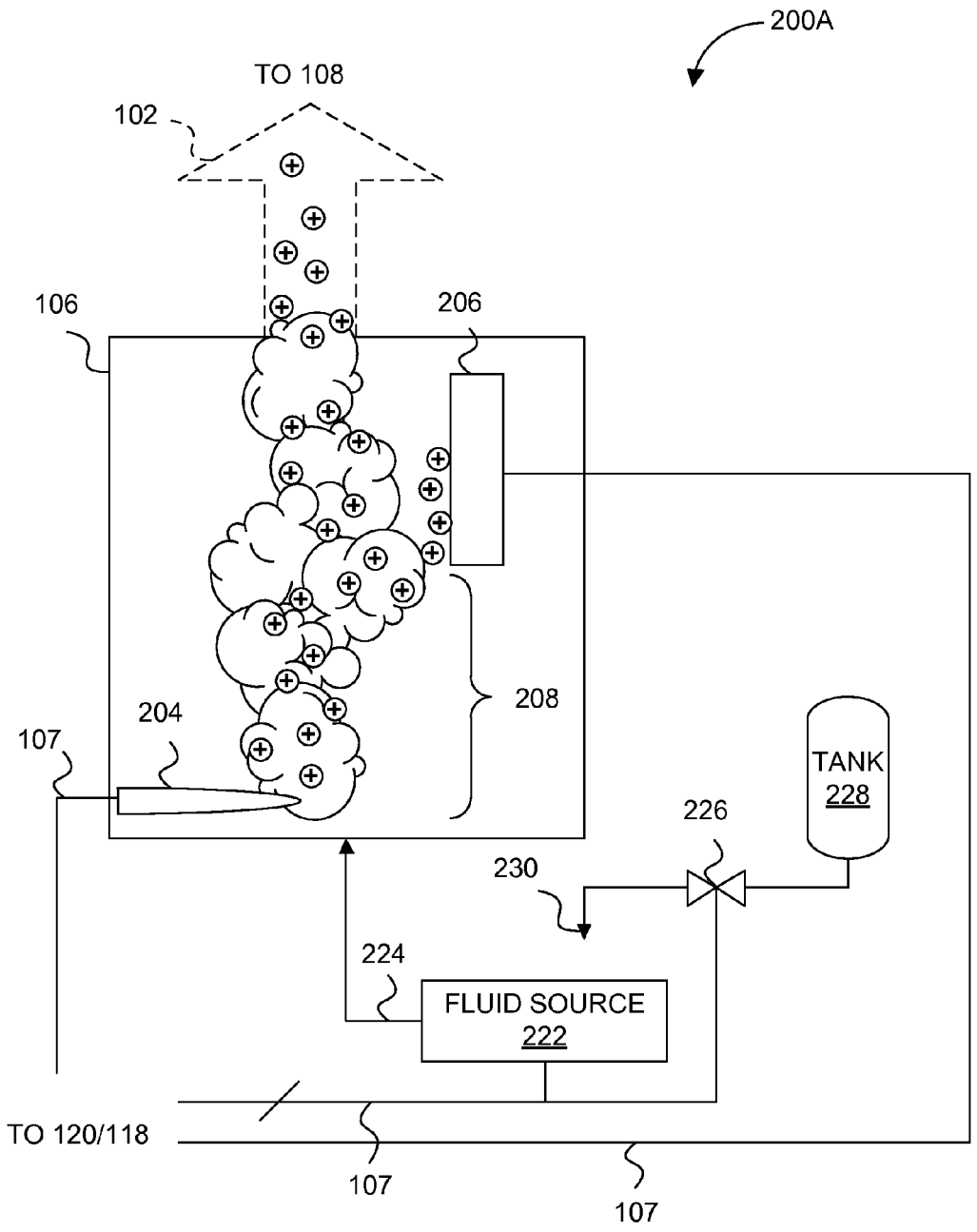
FIG. 2A is a block diagram of an ionizer, according to an embodiment.

FIG. 2A is a diagram of an ionizer 200A, according to an embodiment. The ionizer 200A includes a charge source, such as a corona electrode 204 configured to cooperate with a counter electrode 206 to produce an ion discharge.

According to embodiments, the ionizer 200A is electrically isolated. According to various embodiments, the ionizer 200A imparts charged particles, in the form of ions, to the ion flow 102 via a corona discharge. Additionally or alternatively, the ionizer 200A may impart ions to the ion flow 102 via an electrospray ionization. Additionally or alternatively, the ionizer 200A may impart ions to the ion flow 102 via a thermospray ionization. Additionally or alternatively, the ionizer 200A may impart ions to the ion flow 102 via a field desorption ionization. Additionally or alternatively, the ionizer 200A may impart ions to the ion flow 102 via a photoionization. Additionally or alternatively, the ionizer 200A may impart ions to the ion flow 102 via a photoelectric ionization. Additionally or alternatively, the ionizer 200A may impart ions to the ion flow 102 via a radioactive decay ionization. Additionally or alternatively, the ionizer 200A may impart ions to the ion flow 102 via any combination thereof of the corona discharge, electrospray ionization, thermospray ionization, field desorption ionization, photoionization, photoelectric ionization, and/or radioactive decay ionization.

According to an embodiment, the ionizer 200A imparts a charge to the ion flow 102 via ejection of generated ions (e.g. electrons) at corona electrode 204 to produce negatively charged ions. Additionally or alternatively, the ionizer 200A may impart a charge to the ion flow 102 via extraction of charges (e.g., electrons) from neutral particles proximate the corona electrode 204 to produce positively charged ions. This is also referred to as charge ejection. A counter-electrode 206 applies an electric field to pull the ejected charges away from the corona electrode in a direction toward an entraining dielectric fluid flow and/or toward a location where the ion flow 102 leaves the ionizer body 106. Other ionization modalities, referenced herein or known in the art, may replace the corona/counter electrode 204/206 arrangement shown in FIG. 2A. The ionizer 200A may produce a net charge density at the ionizer 200A of about 1 million charges per cubic centimeter or more, according to embodiments.

According to an embodiment, the controller 120 is configured to detect a short circuit at the corona electrode 204 in the ionizer 200A. The controller 120 is configured to reduce or stop the voltage applied to the corona electrode 204 in the ionizer 200A responsive to the short circuit at the corona electrode 204.

According to embodiments, a fluid source 222 can be configured to provide a fluid 224 to the ionizer 200A in the form of a gas. Additionally or alternatively, the fluid 224 may be provided to the ionizer 200A in the form of a vapor. Additionally or alternatively, the fluid 224 may be provided to the ionizer 200A in the form of a liquid aerosol. Additionally or alternatively, the fluid 224 may be provided to the ionizer 200A in the form of a dielectric liquid stream. Additionally or alternatively, the fluid 224 may be provided to the ionizer 200A in the form of any combination thereof of the gas, vapor, liquid aerosol, and/or liquid stream.

In an embodiment, the fluid source 222 is operatively coupled to provide the fluid 224 to the ionizer 200A using a nebulizer. Additionally or alternatively, the fluid 224 may be provided to the ionizer 200A using an atomizer. The fluid 224 may be provided to the ionizer 200A using an injector. The fluid 224 may be provided to the ionizer 200A using a steam generator. The fluid 224 may be provided to the ionizer 200A using an ultrasonic humidifier. The fluid 224 may be provided to the ionizer 200A using a vaporizer. The fluid 224 may be provided to the ionizer 200A using an evaporator. The fluid 224 may be provided to the ionizer 200A using a pump. Additionally or alternatively, the fluid 224 may be provided to the ionizer 200A using any combination thereof of the nebulizer, atomizer, injector, steam generator, ultrasonic humidifier, vaporizer, evaporator, and/or pump.

According to various embodiments, the ionizer 200A is configured to provide an ion flow 208 by ionizing a fluid 224. The fluid 224 may include a buffer or may be functionalized to hold a charge, and can be impelled by any appropriate means, including, e.g., a pump, fan, compressor, etc. In other embodiments, the fluid source 222 is a combustion air 224 source, and may include either natural draft or forced draft aspects. In other embodiments, the fluid source 222 is a fuel source, such as a hydrocarbon gas source. According to an embodiment, the ionizer 200A is positioned in series with a main fuel line of a combustion system, such that a flow of fuel to a burner of the combustion system passes through the ionizer and incorporates the ion flow 208.

According to other embodiments, a valve 226 is operatively coupled to the fluid source 222 and the controller 120. The controller 120 is configured to operate the valve 226 to control a flow of the fluid 224 from the fluid source 222. The fluid source 222 is configured to supply the fluid 224 to the ionizer 200A and maintain electrical isolation between the conductive and/or grounded parts of the fluid source 222 and the ionizer 200A. The fluid source 222 includes a tank 228 to hold the fluid 224. The tank 228 can be made of an electrically insulating material to isolate the fluid 224 from ground or another voltage. Additionally or alternatively, the tank 228 may be supported by electrical insulators to isolate the fluid 224 from ground or another voltage. An anti siphon 230 arrangement is configured to maintain electrical isolation between the fluid source 222 and the ionizer 200A. However, since corona discharge ionization requires a charge separation across a dielectric layer adjacent to a corona electrode 204 (e.g., exhibited as electric field curvature around emission surfaces), most embodiments are contemplated as being based on a dielectric fluid 224 having a relatively high dielectric constant (i.e., being substantially non-conductive). Accordingly, the anti siphon arrangement 230 may be often embodied as simply a length of low conductivity material or an isolation distance between the corona electrode 204 and adjacent conductive components.

Figure 2B:
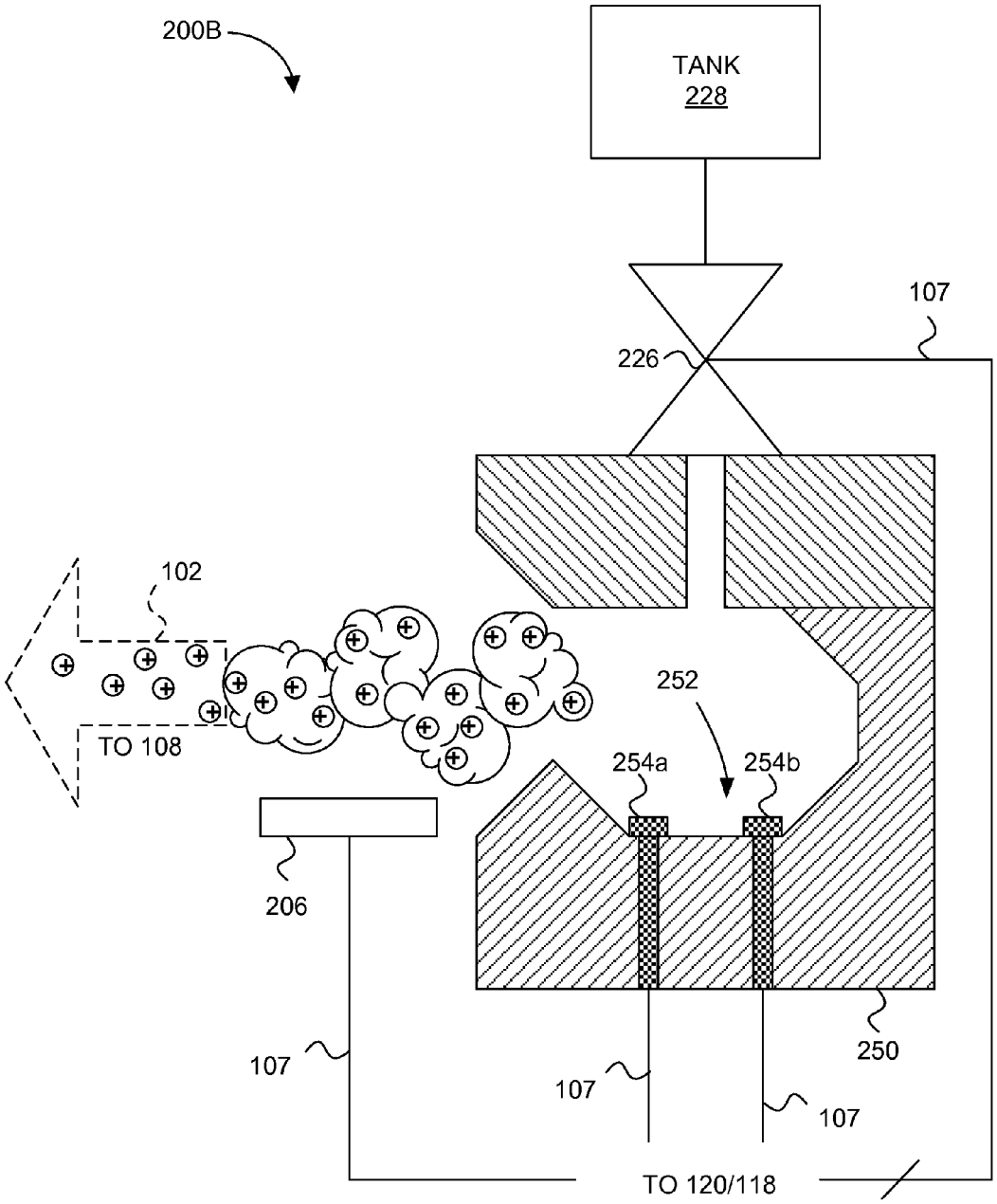
FIG. 2B is a block diagram of an ionizer, according to another embodiment.

FIG. 2B is a sectional diagram of an ionizer 200B, according to another embodiment. According to embodiments, the ionizer 200B includes a body 250 defining a vaporization well 252. Third and fourth electrodes 254*a*, 254*b* are operatively coupled to the voltage source 118 and are configured to apply a high voltage to a liquid at least temporarily resident in the vaporization well 252. The voltage source 118 is configured to apply a voltage to vaporize the liquid to produce a vapor of the liquid. The vapor then carries charged particles from the ionizer. Additionally or alternatively, the voltage source 118 may be configured to apply a voltage to produce an aerosol or a mixed vapor and aerosol of the liquid, which, in either case, carries charged particles from the ionizer.

According to various embodiments, the liquid includes water. Additionally or alternatively, the liquid may include a buffer solution or may be at least partly functionalized to hold a charge.

The electrodes 254*a*, 254*b* are energized at a bias voltage to produce the polarity of the charges carried by the vapor or aerosol. For example, to produce positive charges, the electrode 254*a* can be briefly energized with +40 kV while the electrode 254*b* is energized or held at +20 kV. The 20 kV difference between the electrodes produces vaporization. The +30 kV average voltage operates as a bias voltage to produce positive charges in the ejected vapor/aerosol. In some embodiments, kinetic energy from the vaporization is sufficient to propel the ion flow 102 through the flow distance (e.g., see FIG. 1, 108) to the combustion reaction (not shown in FIG. 2B) or to an entraining fluid stream. Optionally, a counter electrode 206 can be positioned to accelerate the charged particles toward their intended destination as an ion flow 102.

Figure 3:
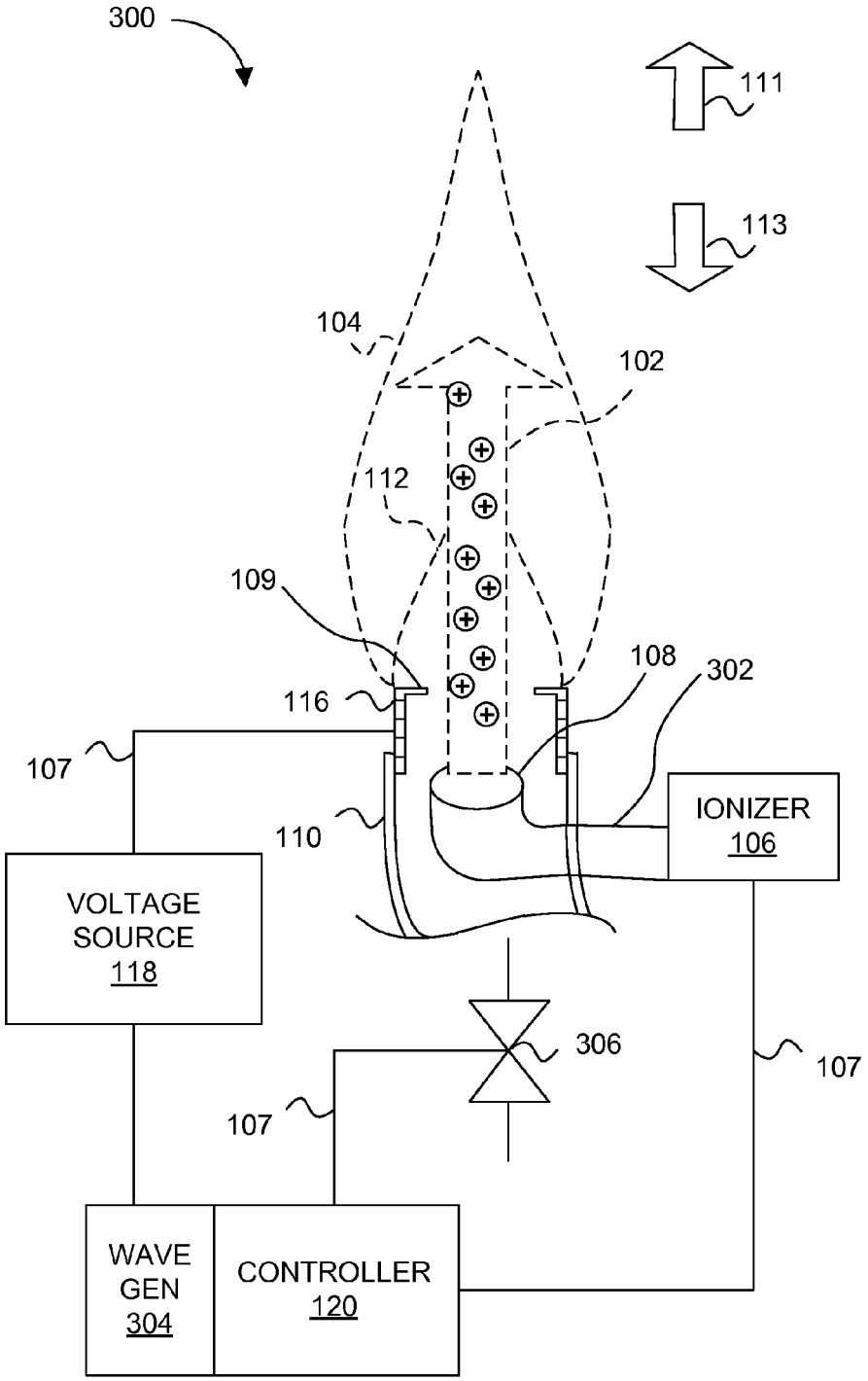
FIG. 3 is a block diagram of a combustion system including an ion flow to control a combustion reaction, according to another embodiment.

FIG. 3 is a diagram of a system 300 for employing an ion flow to control a combustion reaction, according to an embodiment. The ionizer 106 is configured to provide at least a portion of the ion flow 102, which is introduced upstream 113 of the terminus 109 of a burner or fuel source 110. For example, the ionizer 106 can be configured to provide at least a portion of the ion flow 102 through the burner or fuel source 110. In an alternative embodiment (see, e.g., FIGS. 4A and 4B), the ionizer 106 is configured to provide at least a portion of the ion flow 102 downstream 111 from the terminus 109 and upstream 113 from the reaction front 112.

According to embodiments, a conduit 302 is configured to convey the ion flow 102 from the ionizer 106 to the first location 108. The conduit 302 can be electrically isolated. The conduit 302 may include a conduit electrode operatively coupled to the voltage supply, in which case, the controller 120 can be configured to control the voltage supply to apply a voltage at the first polarity to the conduit electrode. The maximum charge density output of the ionizer 106 can be within about 10 centimeters of a downstream 111 terminus of the burner or fuel source 110. The conduit 302 preferably includes a material that resists reaction with the ion flow 102.

The conduit 302 is thermally insulated, according to various embodiments. For example, a portion of the conduit 302 or an opening of the conduit 302 can be shielded from the combustion reaction 104 by a shroud (not shown) located at least in part upstream 113 of the first location 108. The shroud may be thermally reflective. A cooling apparatus (not shown) may be operatively coupled to the conduit 302 to cool the conduit 302.

Referring again to FIG. 3, according to various embodiments, a system 300 may include a flow control valve 306 operatively coupled to the controller 120 and the burner or fuel source 110. The controller 120 is configured to operate the ionizer 106, the voltage source 118, and the flow control valve 306 to control the combustion reaction 104.

According to various embodiments, a system 300 may include a waveform generator 304 that is operatively coupled to the controller 120 and the voltage supply. The waveform generator 304 is configured to generate one or more waveforms. The waveform generator 304 is configured together with the controller 120 to drive the ionizer 106 or the one or more first electrodes 114 with the one or more waveforms. The one or more electrical signals may include the one or more waveforms.

According to embodiments, the waveform generator 304 is configured to generate an alternating current (AC) voltage waveform. Additionally or alternatively, the waveform generator 304 may be configured to generate a sinusoidal waveform. The waveform generator 304 may generate a square waveform. The waveform generator 304 may generate a sawtooth waveform. The waveform generator 304 may generate a triangular waveform. The waveform generator 304 may generate a wavelet waveform. The waveform generator 304 may generate a logarithmic waveform. The waveform generator 304 may generate an exponential waveform. The waveform generator 304 may generate a truncated waveform. The waveform generator 304 may generate a combination of one or more waveform thereof.

Figure 4A:
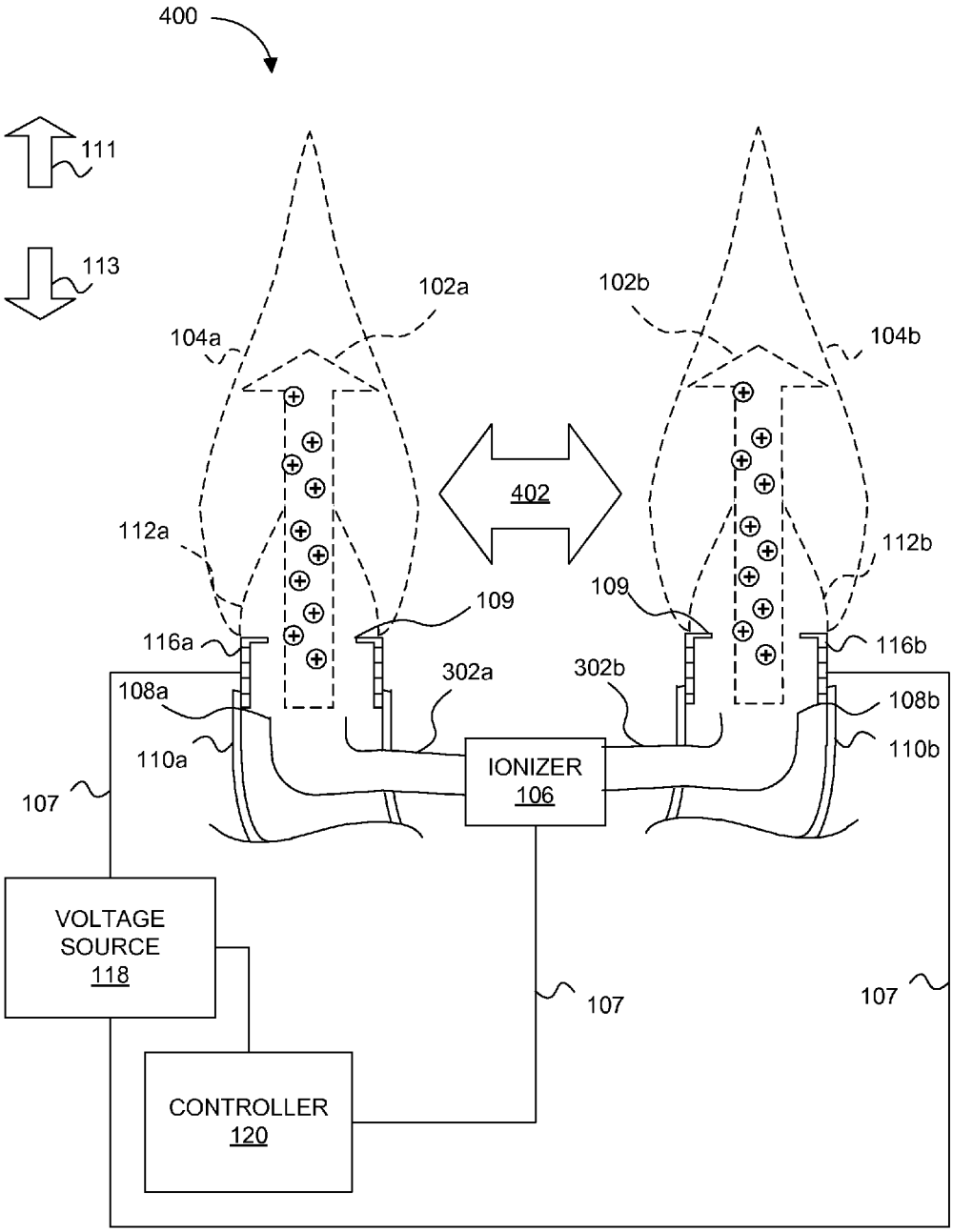
FIG. 4A is a block diagram of a combustion system including a plurality of combustion reactions, according to an embodiment.

FIG. 4A is a block diagram of a system 400 for employing a plurality of ion flows to control the interaction of adjacent combustion reactions, according to an embodiment. The system 400 includes a pair of burners 110*a*, 110*b*, and corresponding second electrodes 116*a*, 116*b* operatively coupled to the voltage source 118. An ionizer 106 includes first and second conduits 302*a*, 302*b* configured to deliver respective ion flows 102*a*, 102*b* to the corresponding combustion reactions 104*a*, 104*b*. As shown in FIG. 4A, the conduits 302*a*, 302*b* are positioned and configured to introduce the ion flows 102 upstream from the opening or terminus of the burner 110.

In the claims, the term sub-flow is used where a plurality of flows of charged particles are introduced to one or more combustion reactions within a same combustion volume. Thus, the ion flows 102*a*, 102*b* of FIG. 4A can also be referred to as sub-flows that together form a single ion flow.

A controller 120 is configured to control the ionizer 106, first electrodes (not shown) and the second electrodes 116 to control the combustion reaction 104. The second electrodes 116 electrically isolated.

The controller 120 is operatively coupled to provide electrical signals to the ionizer 106 and the voltage source 118 to independently control polarity and volume of the ion flows 102*a*, 102*b*. The controller 120 is configured to control the combustion reactions 104 by applying charges to the combustion reactions via the ion flows 102. The controller 120 may also be configured to further control the combustion reactions 104 by applying electrical energy via first electrodes 114, as described above with reference to FIG. 1.

According to one method of operation, the controller is configured to produce an electrostatic repulsion 402 between the first and second instance combustion reactions 104*a*, 104*b*, by controlling the ionizer 106 to produce ion flows 102*a*, 102*b*, having a same polarity, as shown in FIG. 4A. The corresponding net charge applied to the combustion reactions 104*a*, 104*b* causes the combustion reactions to be mutually repulsive.

Figure 4B:
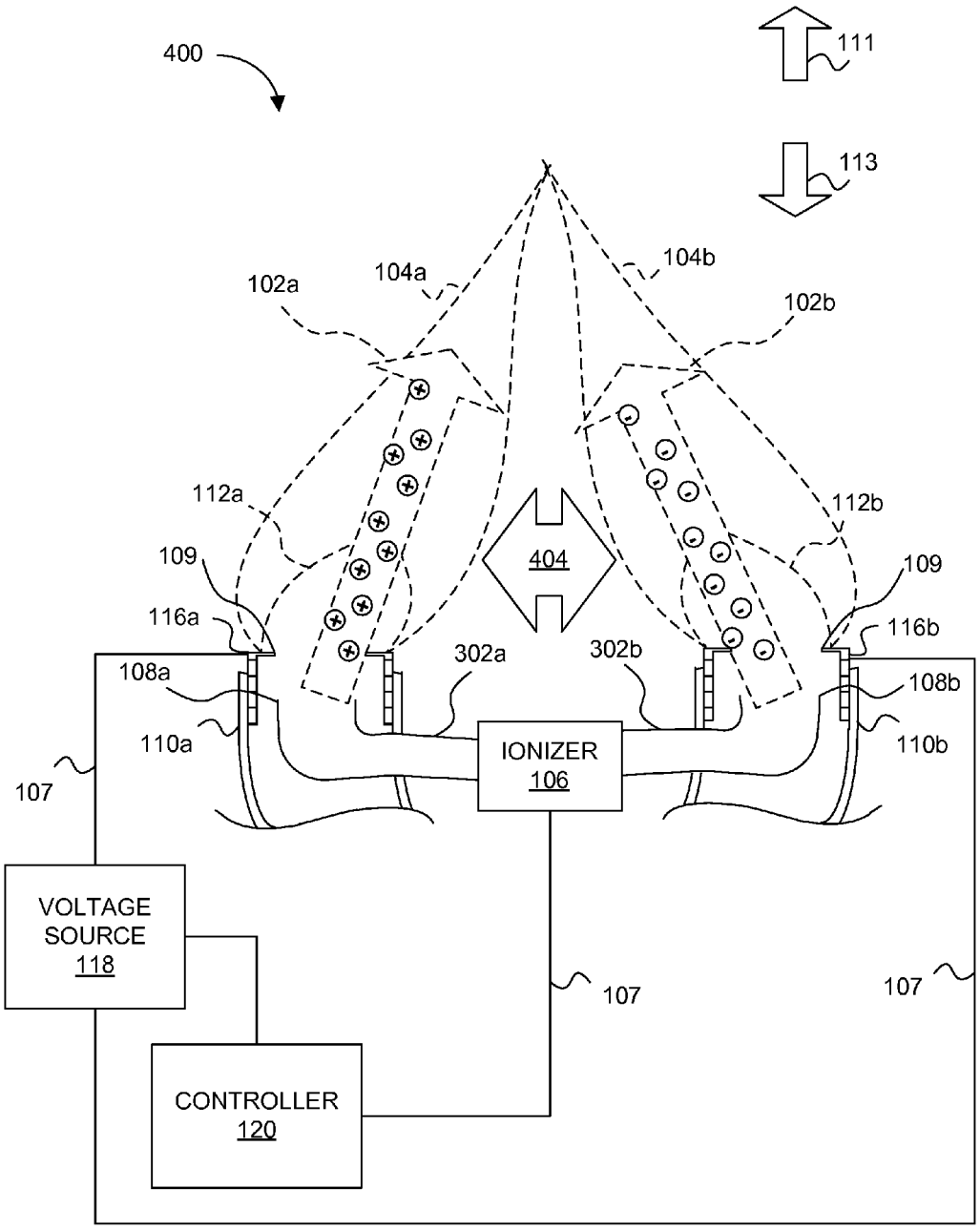
FIG. 4B is a block diagram of the system of FIG. 4A in which ion flows are of opposite polarities, according to an embodiment.

FIG. 4B is a block diagram of the system 400 illustrating a second method of operation, according to an embodiment.

As shown, the controller 120 is configured to control the first and second ion flows 102*a*, 102*b* to have opposite polarities, which produces an electrostatic attraction 404 between the first and second combustion reactions 104*a*, 104*b*. The controller 120 can be configured to control the electrostatic attraction 404 to cause mixing between the first combustion reaction 104*a* and the second combustion reaction 104*b*.

FIG. 5A is a block diagram of a combustion system 500, according to an embodiment. In most respects, the system 500 is substantially identical to the system 400 of FIGS. 4A and 4B. However, where the system 400 is configured to introduce the ion flows 102*a*, 102*b* upstream of the burners 110*a*, 110*b*, the system 500 is configured to introduce the ion flows 102 downstream of the burners 110.

In FIG. 5A, the ion flows 102*a*, 102*b* are have a same polarity, similarly to the operation of the system 400 described with reference to FIG. 4A. As a result of the common polarity of the ion flows 102, the combustion reactions 104*a*, 104*b* are electrically repulsed.

FIG. 5B shows the system 500 of FIG. 5A, with the ionizer 106 controlled to produce the ion flows 102*a*, 102*b* at opposite polarities. As a result, the combustion reactions 104 are attracted to each other, substantially as described with reference to FIG. 4B. In an embodiment, the system 500 can include a second ionizer 106 configured to provide the second ion flow 102*b* having a second polarity to the third location 108*b* downstream 113 of a second reaction front 112*b* of the second combustion reaction 104*b*. The controller 120 can be configured to independently control the first and second instances of the combustion reaction 104*a*, 104*b*. The controller 120 can be further configured to control an electrostatic repulsion 402 between the first instance of the combustion reaction 104*a* and the second instance of the combustion reaction 104*b* by causing the first polarity and the second polarity to be the same. The controller 120 can be further configured to control an electrostatic attraction 404 between the first instance of the combustion reaction 104*a* and the second instance of the combustion reaction 104*b* by causing the first polarity and the second polarity to be different. The controller 120 can be further configured to control the electrostatic attraction 404 to cause mixing between the first instance of the combustion reaction 104*a* and the second instance of the combustion reaction 104*b*.

According to an embodiment, the burner or fuel source 110 can be electrically insulated, electrically isolated, or electrically insulated and isolated. The controller 120 can be configured to operate the ionizer 106 to periodically and/or intermittently change a quantity and/or a concentration of charge in the ion flow 102. The controller 120 can be configured to operate the ionizer 106 to periodically and/or intermittently change a quantity and/or a concentration of charge in the combustion reaction 104. And/or the controller 120 can be configured to operate the ionizer 106 to periodically and/or intermittently change the first charge polarity in the ion flow 102 and/or in the combustion reaction 104.

According to an embodiment, the controller 120 can be configured to apply the one or more electrical signals to the one or more first electrodes 114 to cause a charge of the combustion reaction 104 to respond to the one or more electrical signals. The one or more electrical signals can include a charge, a voltage, an electrical field, or a combination thereof. Additionally, the one or more electrical signals can include one or more of a time-varying charge, a time-varying voltage, a time varying electric field, or a combination thereof. A waveform generator 304 can be included, according to an embodiment. The waveform generator 304 can be operatively coupled to the controller 120 and the power supply 118. The waveform generator 304 can be configured to generate one or more waveforms. The waveform generator 304 can be configured together with the controller 120 to drive the ionizer 106 and/or the one or more first electrodes 114 with the one or more waveforms such that the one or more electrical signals can include the one or more waveforms. The waveform generator 304 can be configured to generate one or more of an alternating current (AC) voltage waveform, a sinusoidal waveform, a square waveform, a sawtooth waveform, a triangular waveform, a wavelet waveform, a logarithmic waveform, an exponential waveform, a truncated waveform, or a combination waveform thereof.

Figure 6:
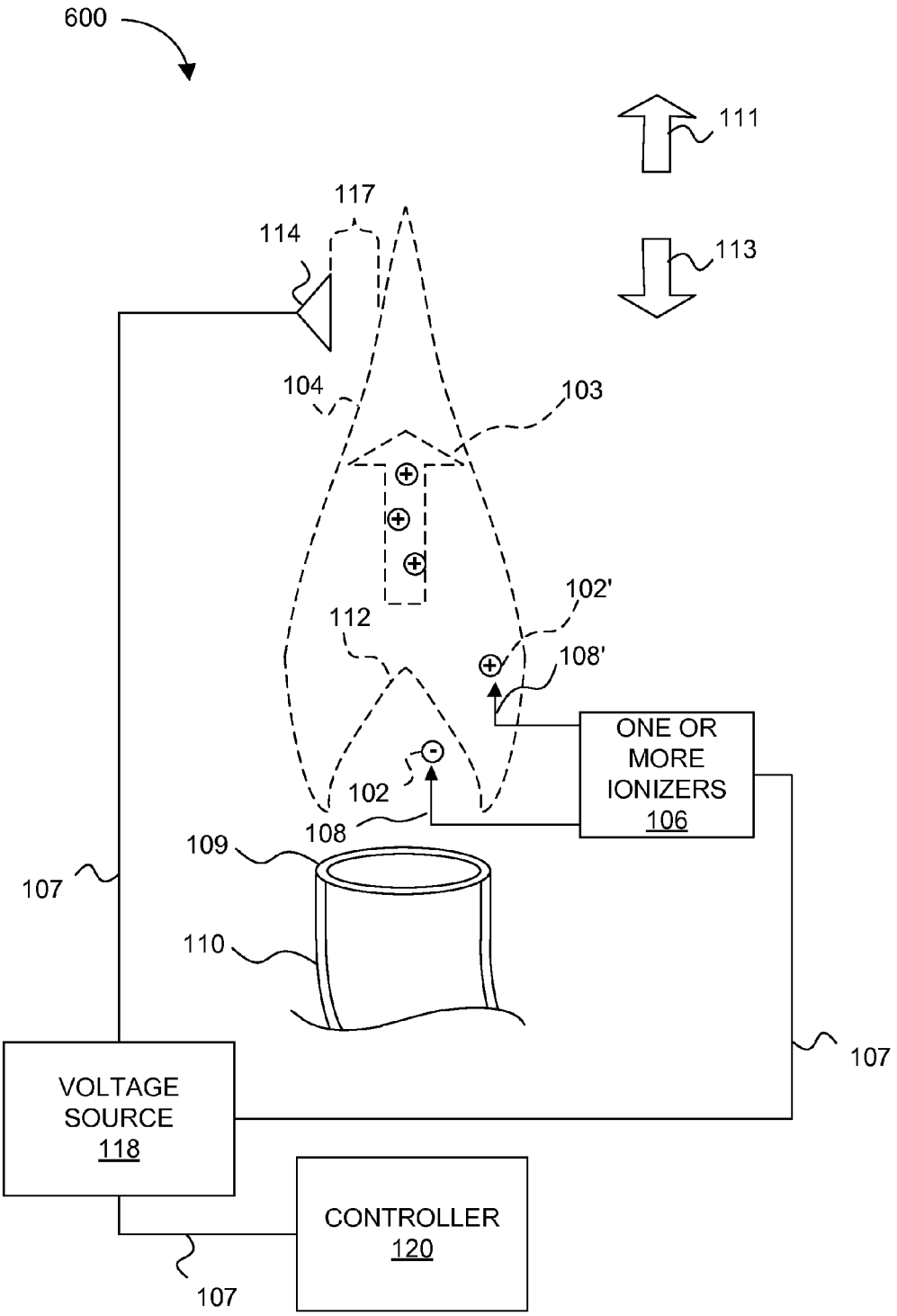
FIG. 6 is a block diagram of a combustion system including a system for employing ion flows to control the interaction of adjacent combustion reactions, according to another embodiment.

FIG. 6 is a block diagram of a system 600 for employing ion flows to control the interaction of adjacent combustion reactions, according to another embodiment. The system 600 is substantially similar to the system 100 of FIG. 1, except that the ionizer 106 is configured to introduce a plurality of ion flows 102 to the combustion reaction 104. In the embodiment shown, a first ion flow 102 is introduced at a first location 108 that is upstream 113 relative to a reaction front 112 of the combustion reaction 104. A second ion flow 102' is introduced at a second location 108' that is upstream 113 relative to the first location 108. The second location 108' may be positioned upstream 113 or downstream 111 relative to the reaction front 112. According to an embodiment, both locations 108, 108' are at least intermittently upstream of the reaction front 112. According to another embodiment, the first location 108 is positioned upstream with respect to the terminus 109 of the burner 110.

The first and second ion flows 102, 102' can be provided by a single ionizer 106, as shown, or by separate ionizers.

In an embodiment, the ionizer 106 is configured to provide the first and second ion flows 102, 102' at first and second polarities effective to cause mixing of the first and second charged ion flows 102, 102'. For example, the opposing first and second polarities can be configured to cause an electrostatic attraction that facilitates mixing of the first and second ion flows 102*a*, 102*b*, and consequently promotes improved mixing of components of the combustion reaction 104.

According to an embodiment, the ionizer 106 is configured to provide the first and second charged ion flows 102, 102' in unequal respective first and second charge quantities or strengths, resulting in a net charge 103 of the combustion reaction 104. By selection of the polarities and strengths of the respective ion flows, the combustion reaction 104 can be further controlled as described with reference to previous embodiments.

Figure 7:
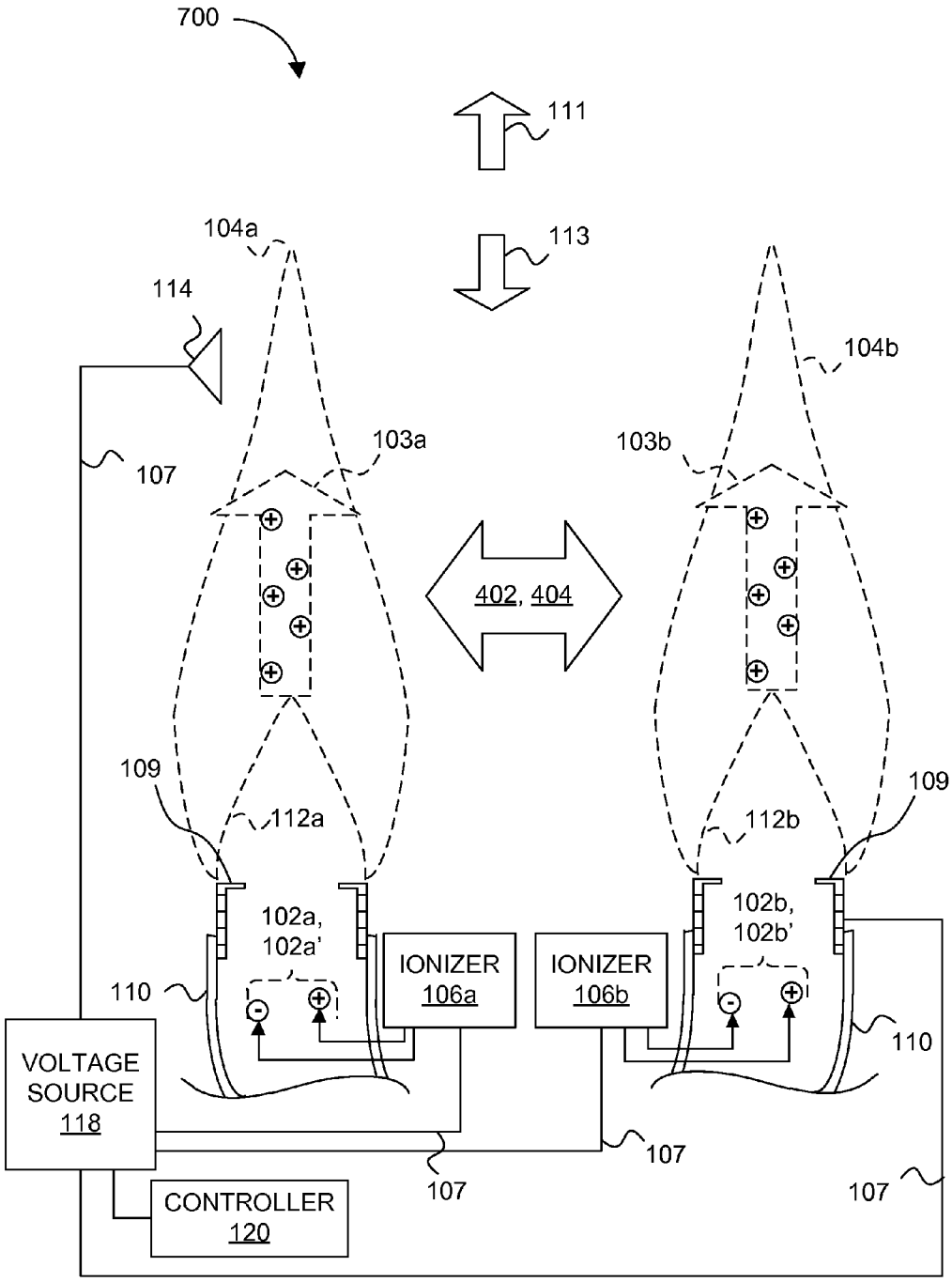
FIG. 7 is a block diagram of a combustion system, according to another embodiment.

FIG. 7 is a block diagram of a system 600 that includes first and second burners 110*a*, 110*b*, each configured to support a respective combustion reaction 104*a*, 104*b*. Each of the first and second burners 110 is associated with respective first and second ion flows 102*a*, 102*a'* and 102*b*, 102*b'*. Each of the first and second burners 110*a*, 110*b* and associated elements operates substantially as described with reference to the system 600 of FIG. 6. Jointly, the combustion reactions 104*a*, 104*b* can be manipulated, by selection of strengths and polarities of the respective ion flows, to function as described with reference to the combustion reactions 104*a*, 104*b* of FIGS. 4A, 4B, 5A, and 5B.

Figure 8:
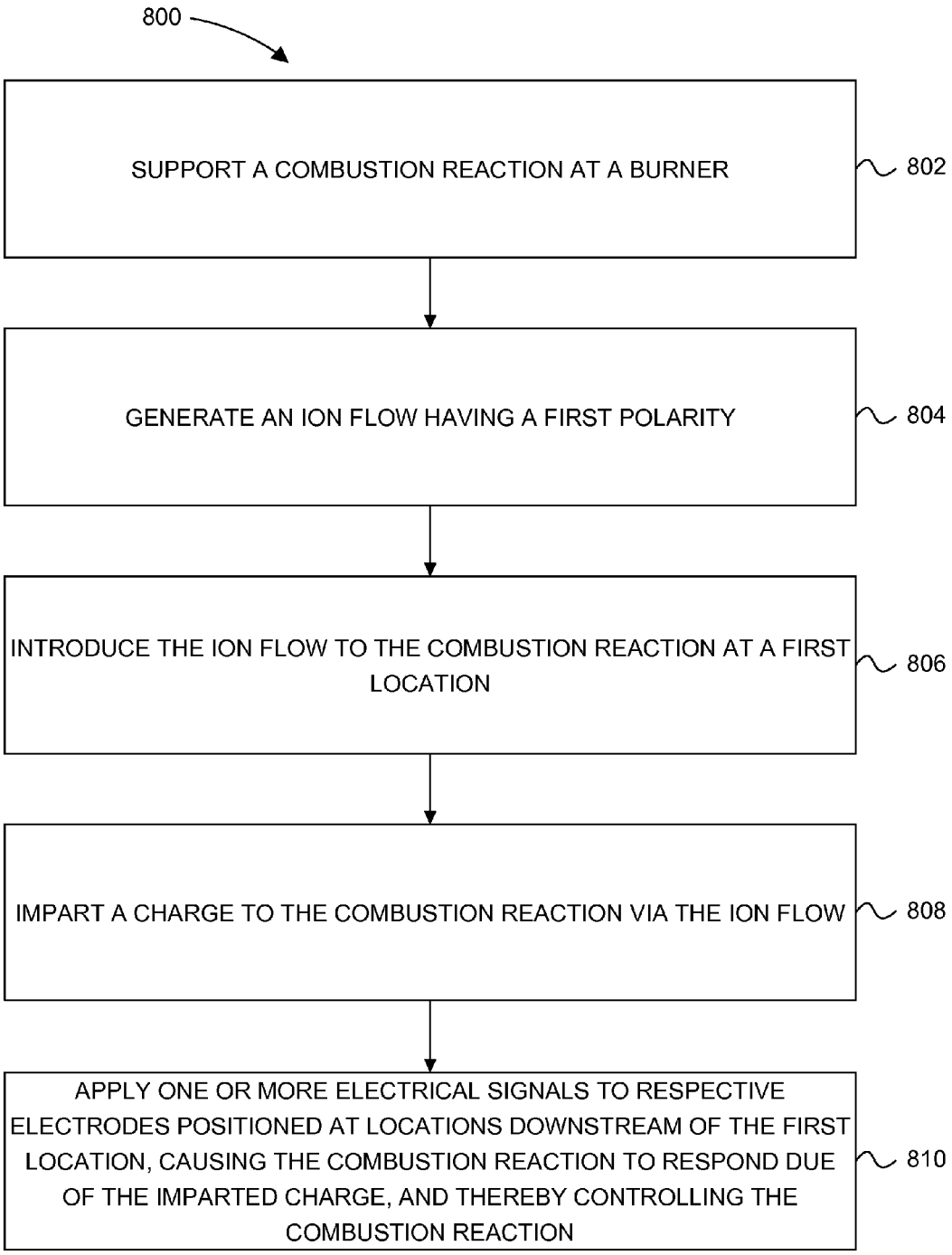
FIG. 8 is a flow diagram of a method for employing an ion flow to control a combustion reaction, according to an embodiment.

FIG. 8 is a flow diagram of a method 500 for employing an ion flow downstream of a reaction front to control a combustion reaction, according to an embodiment. In an embodiment, a method is provided for employing an ion flow to control a combustion reaction. The method includes 802 supporting a combustion reaction at a burner. The method also includes 804 generating an ion flow having a first polarity. The method may further include 806 introducing the ion flow to the combustion reaction or a component of the combustion reaction at a first location. The first location is, according to an embodiment, at least intermittently upstream with respect to at least a portion of a reaction front of the combustion reaction. The method additionally includes 808 imparting a charge to the combustion reaction via the ion flow. The method shown includes 810 controlling the combustion reaction by applying one or more electrical signals to respective electrodes positioned at locations that are downstream of the first location, causing the combustion reaction to respond due to the imparted charge. The one or more electrodes thus control aspects of the combustion reaction by application of the one or more electrical signals.

In an embodiment, imparting the charge can include selecting the ion flow to impart the charge and the first charge polarity to the combustion reaction, a fuel of the combustion reaction, an oxidizer of the combustion reaction, a carrier gas of the combustion reaction, a product of the combustion reaction, another component of the combustion reaction, a combination of components of the combustion reaction, etc.

In an embodiment of the method, controlling the combustion reaction may include extracting ions of a single polarity at the one or more electrodes from the combustion reaction. Generating the ion flow may also include providing a ion flow, such as by ionizing a gas, a vapor, a liquid aerosol, a dry aerosol, a particulate solid, or a combination of elements. Generating the ion flow may also include contacting an ion flow to air or a fuel to form a charged air flow, a charged fuel flow, or a charged air-fuel mixture flow.

In an embodiment, the method can include providing the ion flow at a positive polarity, a negative polarity, or, where multiple ion flows (i.e., sub-flows) are used, both.

In an embodiment, the method may include controlling the combustion reaction such that the first location is substantially upstream over time with respect to the reaction front of the combustion reaction. The method may also include providing at least a portion of the ion flow upstream of the burner or fuel source. The method may further include providing at least a portion of the ion flow through the burner or fuel source. The method may, alternatively, include providing at least a portion of the ion flow downstream from the burner or fuel source and upstream from the reaction front.

In an embodiment, the method may include providing the ion flow by ionizing a gas, a vapor, an aerosol, a particulate solid, an oxidant or a fuel of the combustion reaction, combinations of elements, etc.

In an embodiment, the method may include electrically isolating the ionizer. The method may include imparting ions to the ion flow via a corona discharge. The method may include imparting ions to the ion flow via an electrospray ionization, a thermospray ionization, a field desorption ionization, via a photoionization, a photoelectric ionization, a radioactive decay ionization, etc.

In an embodiment, the method may include imparting a charge to the ion flow via generating and injecting ions, selectively extracting preexisting ions, or a combination thereof. Applying electrical signals to the ionizer to generate the ion flow may include producing a net charge density at the ionizer of at least about 1 million charges per cubic centimeter.

In an embodiment, applying electrical signals to the ionizer to generate the ion flow may include employing a corona electrode and a counter electrode to generate ions in the ionizer. Applying the one or more electrical signals to the ionizer to generate the ion flow may also include detecting a short at the corona electrode in the ionizer. The method may further include reducing the voltage applied to the corona electrode in the ionizer responsive to the short at the corona electrode.

In an embodiment, applying the one or more electrical signals to the ionizer to generate the ion flow may include providing a fluid to the ionizer in the form of a gas, a vapor, an aerosol, a dielectric liquid stream, etc.

In an embodiment, the method may include providing the fluid to the ionizer using a nebulizer, an atomizer, an injector, a steam generator, an ultrasonic humidifier, a vaporizer, an evaporator, a pump, etc.

In an embodiment, applying electrical signals to the ionizer to generate the ion flow may include preparing an ion flow by ionizing a gas, a vapor, a liquid aerosol, a dry aerosol, a liquid, a particulate solid, etc. Applying electrical signals to the ionizer to generate the ion flow may also include forming the ion flow by contacting the ion flow to water, in the form of a vapor, a steam, a liquid, a liquid aerosol, etc. The fluid may include a buffer or be functionalized to hold a charge. The method may also include controlling a flow of the fluid to an ionizer. Applying electrical signals to the ionizer to generate the ion flow may also include supplying the fluid to the ionizer and maintaining electrical isolation between the fluid source and the ionizer. Applying electrical signals to the ionizer to generate the ion flow may also include electrically isolating the fluid from ground or another voltage. Additionally or alternatively, generating an ion flow in step 204 can include attracting ions away from an ion source and toward a desired flow direction can include attracting the ions with a counter-electrode. In the cases where an ion source other than a corona electrode is used, the counter-electrode may be referred to as a propulsion electrode.

In an embodiment, applying electrical signals to the ionizer to generate the ion flow may include applying a voltage to a liquid to vaporize the liquid to produce a vapor, aerosol, or vapor and aerosol of the liquid to carry charged particles. The liquid may include a buffer solution or may be at least partly functionalized to hold a charge.

In an embodiment, introducing the ion flow at the first location may include conveying the ion flow from the ionizer to the first location using a conduit. Introducing the ion flow at the first location may also include electrically isolating the conduit. Generally speaking, the conduit is formed at least partially from a dielectric material selected to maintain electrical insulation between the combustion reaction and the ionizer. The use of a dielectric conduit can prevent the conduit from acting as an immersed electrode in direct contact with the combustion reaction. In an embodiment, the conduit can be formed from fused quartz glass or other ceramic material that maintains relatively high electrical resistivity at temperatures encountered in the combustion volume. The method may include applying a voltage at the first polarity to the conduit electrode. Introducing the ion flow at the first location may further include providing a maximum charge density output of the ionizer within about 10 centimeters of a downstream terminus of the burner or fuel source. Introducing the ion flow at the first location may also include employing a conduit material that resists reaction with the ion flow. Introducing the ion flow at the first location may further include thermally insulating the conduit or cooling the conduit.

In an embodiment, the method may also include electrically isolating the one or more electrodes from ground or another voltage. Controlling the combustion reaction may include at least intermittently separating the one or more electrodes from the combustion reaction by an air gap. Controlling the combustion reaction may also include controlling the voltage supply and the ionizer to maintain the air gap between the combustion reaction and the one or more first electrodes. Controlling the combustion reaction may further include at least intermittently holding the combustion reaction at the burner or fuel source.

In an embodiment, controlling the combustion reaction may include controlling two or more combustion reactions. Controlling the combustion reaction may include causing an electrostatic repulsion between the first combustion reaction and the second combustion reaction by charging the first combustion reaction and the second combustion reaction at the first polarity. Controlling the combustion reaction may also include causing an electrostatic attraction between the first combustion reaction and the second combustion reaction by charging the first combustion reaction at the first polarity and charging the second combustion reaction at a second polarity opposite the first polarity. Controlling the combustion reaction may further include controlling the electrostatic attraction to cause mixing between the first combustion reaction and the second combustion reaction.

In an embodiment, the method may include electrically isolating the burner or fuel source. Controlling the combustion reaction may include operating a flow valve operatively coupled to the burner or fuel source. Controlling the combustion reaction may also include periodically or intermittently changing a quantity or a concentration of ions in the ion flow or in the combustion reaction. Controlling the combustion reaction may further include periodically or intermittently changing the polarity of the ion flow or the combustion reaction.

In an embodiment, controlling the combustion reaction may include applying the one or more electrical signals including a charge, a voltage, an electrical field, or a combination thereof. Controlling the combustion reaction may also include applying the one or more electrical signals including one or more of: a time-varying charge, a time-varying voltage, a time varying electric field, or a combination thereof. Controlling the combustion reaction may further include generating one or more waveforms. Controlling the combustion reaction may also include driving the ionizer or the one or more electrodes with the one or more waveforms such that the one or more electrical signals include the one or more waveforms. Generating one or more waveforms may include generating one or more of: an alternating current (AC) voltage waveform, a sinusoidal waveform, a square waveform, a sawtooth waveform, a triangular waveform, a wavelet waveform, a logarithmic waveform, an exponential waveform, a truncated waveform, a DC offset voltage, etc.

The method may also include supporting the combustion reaction to include a flame.

According to embodiments, the combustion reaction can be supported by either a diffusion, partial premix, or premixed burner.

According to a premixed burner embodiment, the ion (or charged particle) flow 102 can be introduced to the combustion reaction through a premixing chamber. For example, a charged particle source such as a corona electrode 204 and counter electrode 206 pair can be disposed in the premixing chamber, and the premixing chamber and any flame arrestor can be held or allowed to float to a voltage that allows the charged particle flow 102 to pass through the flame arrestor and into the combustion reaction. In another example, a charged particle delivery conduit 302 can deliver the charged particle flow 102 from a charged particle source into the premixing chamber.

In another premixed burner embodiment, the charged particle flow 102 can be introduced above a flame arrestor and below a flame holder into a premixed fuel/air flow. The charged particle flow can be generated by a charged particle source such as a corona electrode 204 and counter electrode 206 pair can be disposed in the premixed fuel/air flow between the flame arrestor and below the flame holder, and the flame arrestor or other conductive surface past which the charged particles may flow (e.g., the flame holder) can be held or allowed to float to a voltage that allows the charged particle flow 102 to pass through the flame holder and into the combustion reaction 104. In another example, a charged particle delivery conduit 302 can deliver the charged particle flow 102 from a charged particle source into the premixed fuel/air flow between the flame arrestor and below the flame holder. Of course, if it is desired to cause the fuel/air flow to support a combustion reaction that is held by the flame holder, then the flame holder can optionally be configured as the first electrode 114 (and be held at a voltage different from a voltage that would allow the charged particle flow 102 to pass by the flame holder. In the case of an aerodynamic flame holder, the flame holder can be formed from an electrically insulating material or can be held or allowed to float to an equilibrium voltage. In this case, the resultant charge concentration in the combustion reaction 104 can be used for purposes other than holding the combustion reaction.

In another premixed burner embodiment, the ion flow 102 can be introduced above a flame holder into a premixed fuel/air flow and/or into a combustion reaction above a flame holder. The ion flow can be generated by a charged particle source, such as a corona electrode 204 and counter electrode 206 pair, can be disposed outside the combustion volume. A charged particle delivery conduit 302 can deliver the charged particle flow 102 from the charged particle source into the fuel/air flow or into the combustion reaction 104.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. An electrodynamic burner, comprising:

a fuel nozzle configured to provide fuel to support a combustion reaction;

an ionizer configured to generate charged particles, the ionizer being positioned away from the fuel nozzle and separated from contact with the combustion reaction by a charged particle transport path; and a first electrode configured as a conductive flame holder positioned at a distance from the fuel nozzle to receive fuel from the fuel nozzle, the distance operating as a mixing zone to entrain air and/or flue gas into the fuel;

wherein the ionizer is configured to cause charged particles to flow along the transport path to electrically charge the combustion reaction;

wherein the electrical charge carried by the combustion reaction is configured to cooperate with the conductive flame holder to hold the combustion reaction proximate the conductive flame holder; and wherein entrainment and dilution of the fuel reduces a combustion reaction temperature to reduce production of oxides of nitrogen (NOx) by the burner.

2. The electrodynamic burner of claim 1, wherein the fuel nozzle is configured to provide fuel to flow past the flame holder at a velocity greater than a flame propagation velocity.

3. The electrodynamic burner of claim 1, further comprising:

an electrode controller configured to control the ionizer.

4. The electrodynamic burner of claim 3, wherein the electrode controller is configured to cause the ionizer to output a time-varying charge concentration.

5. The electrodynamic burner of claim 4, wherein the time-varying charge concentration includes a periodically varying charge concentration.

6. The electrodynamic burner of claim 4, wherein the time-varying charge concentration includes a time-varying polarity of charges.

7. The electrodynamic burner of claim 4, wherein the time-varying charge concentration includes a periodicity having a frequency between about 200 and about 800 Hertz.

8. The electrodynamic burner of claim 7, wherein the periodicity is characterized by a sinusoidal variation in charge concentration.

9. The electrodynamic burner of claim 7, wherein the periodicity is characterized by a square wave variation in charge concentration.

10. The electrodynamic burner of claim 1, wherein the flame holder is electrically isolated from ground and from voltages not carried by the charged particles.

11. The electrodynamic burner of claim 1, wherein the fuel nozzle is conductive and electrically isolated from ground and from voltages not carried by the charged particles.

12. The electrodynamic burner of claim 1, wherein the flame holder and the fuel nozzle are in electrical continuity with one another.

13. The electrodynamic burner of claim 1, further comprising:

a plurality of flame holders disposed at two or more distances from the fuel nozzle.

14. The electrodynamic burner of claim 13, further comprising:

a controller configured to switch electrical continuity between a holding voltage and the plurality of flame holders.

* * * * *